US008752409B2

(12) United States Patent
Weisshaar

(10) Patent No.: US 8,752,409 B2
(45) Date of Patent: Jun. 17, 2014

(54) METHOD FOR A OPERATING A ROLLING MILL TRAIN WITH CURVATURE RECOGNITION

(75) Inventor: Bernhard Weisshaar, Herzogenaurach (DE)

(73) Assignee: Siemens Aktiengesellschaft, Munich (DE)

( * ) Notice: Subject to any disclaimer, the term of this patent is extended or adjusted under 35 U.S.C. 154(b) by 762 days.

(21) Appl. No.: 12/677,605

(22) PCT Filed: Aug. 21, 2008

(86) PCT No.: PCT/EP2008/060967

§ 371 (c)(1),
(2), (4) Date: Mar. 11, 2010

(87) PCT Pub. No.: WO2009/037064

PCT Pub. Date: Mar. 26, 2009

(65) Prior Publication Data

US 2010/0242566 A1 Sep. 30, 2010

(30) Foreign Application Priority Data

Sep. 13, 2007 (DE) ..... 10 2007 043 793
Feb. 1, 2008 (DE) ..... 10 2008 007 247

(51) Int. Cl.
*B21B 37/72* (2006.01)

(52) U.S. Cl.
USPC ..... 72/7.5; 72/8.3; 72/8.6; 72/12.5

(58) Field of Classification Search
USPC ..... 72/8.6, 8.7, 8.8, 9.1, 365.2, 7.1, 7.5, 72/8.3, 9.2, 11.1, 11.2, 11.5, 12.3, 12.5; 700/152
See application file for complete search history.

(56) References Cited

U.S. PATENT DOCUMENTS

| | | | | |
|---|---|---|---|---|
| 2,292,535 | A * | 8/1942 | MacChesney | 72/11.2 |
| 3,184,938 | A * | 5/1965 | Terwilliger | 72/11.5 |
| 3,782,155 | A | 1/1974 | Bald | 72/12.5 |
| 4,149,395 | A * | 4/1979 | Fapiano | 72/11.7 |
| 4,570,472 | A * | 2/1986 | Kuwano | 72/8.4 |
| 4,794,773 | A * | 1/1989 | Bradlee | 72/8.3 |

(Continued)

FOREIGN PATENT DOCUMENTS

| | | | |
|---|---|---|---|
| DE | 102004043790 | 3/2006 | B21B 31/16 |
| EP | 0684091 | 11/1995 | B21B 37/68 |

(Continued)

OTHER PUBLICATIONS

International Search Report for Application No. PCT/EP2008/060967 (12 Pages), Nov. 17, 2008.

*Primary Examiner* — Edward Tolan
(74) *Attorney, Agent, or Firm* — King & Spalding L.L.P.

(57) ABSTRACT

In a multi-stand rolling mill train, a strip successively runs through individual rolling stands. The strip—always as seen in relation to a rolling center line—is threaded into each of the rolling stands with known respective head offset and inlet-side head pitch, and therefore a strip head emerges with the respective head offset, a respective outlet-side head pitch and a respective outlet-side head curvature. The respective outlet-side head pitch is determined on the basis of respective inlet-side head pitch and pass reduction which takes place in the respective rolling stand. The respective outlet-side head curvature of the strip is determined based on respective measured and further data. The respective outlet-side head curvature is used to determine a respective control intervention for the respective rolling stand and/or the one arranged directly downstream and to drive the corresponding rolling stand in accordance with the respective determined control intervention.

16 Claims, 7 Drawing Sheets

(56) References Cited

U.S. PATENT DOCUMENTS

| | | | | | |
|---|---|---|---|---|---|
| 4,989,164 | A | * | 1/1991 | Desrousseaux | 702/40 |
| 5,513,097 | A | * | 4/1996 | Gramckow et al. | 700/48 |
| 5,722,279 | A | * | 3/1998 | Ogawa et al. | 72/11.4 |
| 6,035,259 | A | * | 3/2000 | Graff et al. | 702/43 |
| 6,098,060 | A | * | 8/2000 | Yuan et al. | 706/26 |
| 6,601,422 | B2 | * | 8/2003 | Hartmann et al. | 72/7.6 |
| 7,310,982 | B2 | * | 12/2007 | Ogawa et al. | 72/10.4 |
| 7,823,428 | B1 | * | 11/2010 | Malik et al. | 72/7.1 |
| 2010/0031723 | A1 | * | 2/2010 | Hofer et al. | 72/199 |
| 2010/0242566 | A1 | | 9/2010 | Weisshaar | 72/365.2 |

FOREIGN PATENT DOCUMENTS

| | | | | | |
|---|---|---|---|---|---|
| JP | 57-39018 | A | * | 3/1982 | B21B 37/00 |
| JP | 59-13506 | A | * | 1/1984 | B21B 37/00 |
| JP | 55-103212 | A | * | 7/1985 | B21B 37/00 |
| JP | 60-238024 | A | * | 11/1985 | B21B 37/00 |
| JP | 61-242712 | A | * | 10/1986 | B21B 37/00 |
| JP | 63123511 | | | 5/1988 | B21B 37/00 |
| JP | 63171213 | | | 7/1988 | B21B 37/00 |
| JP | 64-48615 | A | * | 2/1989 | B21B 37/00 |
| JP | 64-53712 | A | * | 3/1989 | B21B 37/00 |
| JP | 2020608 | A | | 1/1990 | B21B 37/00 |
| JP | 4266414 | A | | 9/1992 | B21B 37/00 |
| SU | 518114 | A3 | | 6/1976 | B21B 37/00 |
| SU | 1340851 | A1 | | 9/1987 | B21B 37/28 |
| WO | WO 2006136483 | A1 | * | 12/2006 | |
| WO | 2009/037064 | A1 | | 3/2009 | B21N 37/68 |

* cited by examiner

METHOD FOR A OPERATING A ROLLING MILL TRAIN WITH CURVATURE RECOGNITION

CROSS-REFERENCE TO RELATED APPLICATIONS

This application is a U.S. National Stage Application of International Application No. PCT/EP2008/060967 filed Aug. 21, 2008, which designates the United States of America, and claims priority to German Application No. 10 2007 043 793.7 filed Sep. 13, 2007 and German Application No. 10 2008 007 247.8 filed Feb. 1, 2008, the contents of which are hereby incorporated by reference in their entirety.

TECHNICAL FIELD

The present invention relates to an operating method for a rolling train that has a plurality of rolling stands through which a strip runs successively, the strip—always as seen relative to a rolling center line—being threaded into each of the rolling stands with a known respective head displacement and a known respective inlet side head pitch, such that a strip head of the strip is outlet from the respective rolling stand with the respective head displacement, a respective outlet side head pitch and a respective outlet side head curvature.

The present invention further relates to a computer program that has machine code which can be executed directly by a control device of a multistand rolling train, and the execution of which via the control device has the effect that the control device operates the rolling train in accordance with such an operating method.

The present invention further relates to a data medium having a computer program of the above-described type stored on the data medium.

Furthermore, the present invention relates to a control device of a multistand rolling train, the control device being configured in such a way that it operates the rolling train in accordance with an operating method described above.

Finally, the present invention relates to a rolling train, in which the rolling train has a plurality of rolling stands through which a strip runs successively, and in which the rolling train has a control device of the type described above such that when in operation the rolling train is operated in accordance with an operating method of the above-described type.

BACKGROUND

When a strip is being rolled, tension differences can occur between the strip edges of the strip. One of the substantial causes of the tension differences is a wedge in the strip profile. A wedge in the strip profile can have various causes. Thus, for example, the strip can already have a wedge-shaped profile before being rolled. Alternatively, the wedge can be caused by the rolling in the roll gap. A plurality of causes come into discussion for lending the strip a wedge-shaped profile. For example, the strip can have a wedge-shaped temperature distribution and the strip can enter the roll gap eccentrically, or the roll gap itself can be wedge-shaped. Combinations of these (and other) causes are also possible.

It is known in the prior art to acquire the stress differences occurring in the strip by arranging between two respective stands a loop lifter that is equipped with force transducers on both side arms. However, conventional loop lifters have only lateral force measurement, and therefore deliver only a total force, but not a differential force between the two strip edges. The tension distribution in the strip is therefore unknown without a loop lifter with force sensors on both sides. It is therefore impossible to predict the direction in which the strip is deflected when the strip foot of the strip runs out of one of the rolling stands. However, particularly at the rear stands of a multistand rolling train an adjustment of the swivel value or other control elements of the rolling stand arranged directly downstream of the respective rolling stand is not possible quickly enough in order to prevent the strip foot from striking against a side guide of the rolling train.

Furthermore, it is known in the prior art for a controller of the rolling train to track the strip head visually as the strip is being threaded in and—in accordance with his personal impression of strip position and strip corrugation—to set the adjustment of the rolling stand currently being run through by the strip head (in particular a swivel position of the rollers).

SUMMARY

According to various embodiments, options can be provided by means of which it is possible to detect and/or avoid a wedge in the strip, and/or it is possible to detect and/or avoid tension differences between the strip edges, without this requiring a loop lifter with force acquisition on both sides.

According to an embodiment, an operating method for a rolling train that has a plurality of rolling stands through which a strip runs successively, may comprise the steps of:

- the strip—always as seen relative to a rolling center line—being threaded into each of the rolling stands with a known respective head displacement and a known respective inlet side head pitch, such that a strip head of the strip is outlet from the respective rolling stand with the respective head displacement, a respective outlet side head pitch and a respective outlet side head curvature,
- the respective outlet side head pitch being determined with the aid of the respective inlet side head pitch and a respective pass reduction taking place in the respective rolling stand,
- the respective outlet side head curvature of the strip being determined with the aid of respective measured data and respective further data,
- the respective outlet side head curvature being used to determine a respective control intervention for the respective rolling stand, and/or for the rolling stand arranged directly downstream of the respective rolling stand, and
- the respective rolling stand and/or the rolling stand arranged directly downstream of the respective rolling stand being driven in accordance with the determined respective control intervention.

According to a further embodiment, a respective intermediate stand head displacement of the strip head can be acquired by means of a respective position acquisition device arranged between the respective rolling stand and the rolling stand arranged directly downstream of the respective rolling stand, and in that the respective measured data correspond to the respective acquired intermediate stand head displacement, and the respective further data correspond to the respective head displacement and the respective outlet side head pitch. According to a further embodiment, the respective head displacement, the respective outlet side head pitch and the respective outlet side head curvature can be stored, after the threading of the strip into the last rolling stand of the rolling train the strip located between the rolling stands can be subjected to tension, the strip—always as seen relative to the rolling center line—can be inlet into each of the rolling stands with a known respective strip displacement and a known respective inlet side strip pitch, and is outlet from the respective rolling stand with the respective strip displacement, a respective outlet side strip pitch and a respective outlet side strip curvature, the respective outlet side strip pitch can eb determined with the aid of the respective inlet side strip pitch and the respective pass reduction taking place in the respective rolling stand, a respective intermediate stand strip displacement of the strip can be acquired by means of the position acquisition device arranged directly downstream of the respective rolling stand, the respective outlet side strip curvature can be determined with the aid of the respective strip displacement, the respective outlet side strip pitch and the respective intermediate stand strip displacement, and the respective strip displacement, the respective outlet side strip pitch and the respective intermediate stand strip displacement can also be used to determine the respective control intervention. According to a further embodiment, the respective control intervention can be determined in such a way that the respective control intervention counteracts a deflection of a strip foot of the strip as the strip foot is outlet from the respective rolling stand. According to a further embodiment, the respective rolling stand and/or the rolling stand arranged directly downstream of the respective rolling stand can be driven at an instant corresponding to the determined respective control intervention at which the strip being inlet into the respective rolling stand is subjected to tension. According to a further embodiment, the respective rolling stand and/or the rolling stand arranged directly downstream of the respective rolling stand can be driven at an instant corresponding to the determined respective control intervention at which the strip being inlet into the respective rolling stand is free from tension. According to a further embodiment, the respective head displacement, the respective outlet side head pitch and the respective outlet side head curvature of the respective rolling stand can be used to determine the respective head displacement and the respective inlet side head pitch for the rolling stand arranged directly downstream of the respective rolling stand. According to a further embodiment, a mathematical-physical model may be fed the respective head displacement and the respective outlet side head pitch, actual quantities of the strip being inlet into the respective rolling stand and of the strip being outlet from the respective rolling stand, as well as variables and parameters of the respective rolling stand, and in that the respective outlet side head curvature is determined by means of the mathematical-physical model. According to a further embodiment, after the determination of the respective outlet side head curvature by means of the mathematical-physical model a respective intermediate stand head displacement of the strip may be additionally acquired by means of a respective position acquisition device arranged between the respective rolling stand and the rolling stand arranged directly downstream of the respective rolling stand, and the respective outlet side head curvature can be corrected with the aid of the respective acquired intermediate stand head displacement, the respective head displacement and the respective outlet side head pitch. According to a further embodiment, the mathematical-physical model can be adapted with the aid of a deviation of the respective outlet side head curvature determined by means of the mathematical-physical model from the corrected respective outlet side head curvature. According to a further embodiment, the respective control intervention can be determined directly after the determination of the respective outlet side head curvature, and in that directly after the determination of the respective control intervention the respective rolling stand is driven in accordance with the determined respective control intervention. According to a further embodiment, the rolling stand arranged directly downstream of the respective rolling stand can be driven in accordance with the determined respective control intervention at the latest as the strip is being threaded into the rolling stand arranged directly downstream of the respective rolling stand. According to a further embodiment, the respective outlet side head curvature can be constant. According to a further embodiment, the respective outlet side head curvature may vary with a distance from the respective rolling stand.

According to another embodiment, a computer program may have machine code which can be executed directly by a control device of a multistand rolling train, and the execution of which via the control device has the effect that the control device operates the rolling train in accordance with an operating method as described above.

According to yet another embodiment, a data medium may have a computer program as described above stored on the data medium.

According to yet another embodiments, a control device of a multistand rolling train, can be configured in such a way that it operates the rolling train in accordance with an operating method as described above.

According to a further embodiment, the control device can be designed as a software programmable control device that in operation executes a computer program as described above.

According to yet another embodiment, a rolling train has a plurality of rolling stands through which a strip runs successively, and a control device as described above such that when in operation the rolling train is operated in accordance with an operating method described above.

BRIEF DESCRIPTION OF THE DRAWINGS

Further advantages and details emerge from the following description of exemplary embodiments in conjunction with the drawings, of which in illustration of the principles.

DETAILED DESCRIPTION

Figure 1:
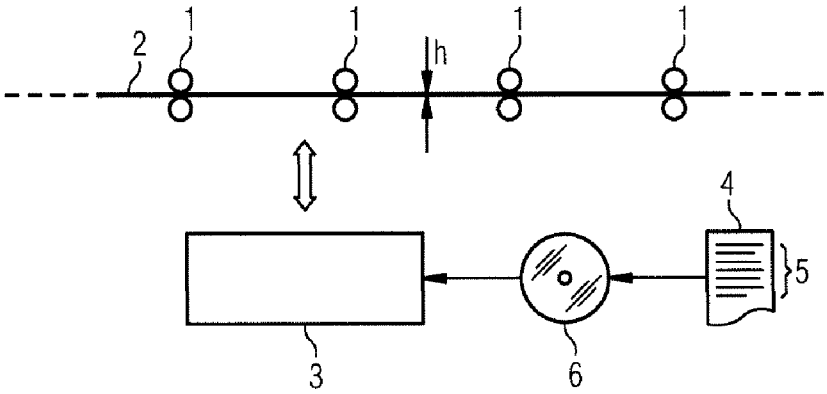
FIG. 1 is a schematic of a multistand rolling train.

According to various embodiments, it is provided in the case of an operating method of the type described at the beginning

- that the respective outlet side head pitch is determined with the aid of the respective inlet side head pitch and a respective pass reduction taking place in the respective rolling stand,
- that the respective outlet side head curvature of the strip is determined with the aid of respective measured data and respective further data,
- that the respective outlet side head curvature is used to determine a respective control intervention for the respective rolling stand, and/or for the rolling stand arranged directly downstream of the respective rolling stand, and that the respective rolling stand and/or the rolling stand arranged directly downstream of the respective rolling stand is/are driven in accordance with the determined respective control intervention.

In a first possible refinement of the operating method according to various embodiments, it is provided that a respective intermediate stand head displacement of the strip head is acquired by means of a respective position acquisition device arranged between the respective rolling stand and the rolling stand arranged directly downstream of the respective rolling stand, and that the respective measured data correspond to the respective acquired intermediate stand head displacement, and the respective further data correspond to the respective head displacement and the respective outlet side head pitch. With this procedure, the head curvature may be determined cost-effectively in a particularly simple and reliable way. The position acquisition device can be designed hereby in any way desired, as long as it has the desired functionality. For example, the respective position acquisition device can be designed as a line scanner (infrared scanner, diode line scanner etc), or as an imaging camera. Other refinements are also possible. As a rule, the position acquisition devices are of the same design as each other.

However, this is not mandatory. The position acquisition device can also be designed individually in each case from intermediate stand region to intermediate stand region.

For example, in the scope of the last-named refinement, that is to say in the case of the presence of position acquisition devices between two rolling stands each, it is possible directly after the acquisition of the intermediate stand head displacement of the respective rolling stand to determine the head displacement and the inlet side head pitch for the rolling stand arranged directly downstream of the respective rolling stand, to determine the control command for the rolling stand arranged directly downstream of the respective rolling stand, and to output the control command to the rolling stand arranged directly downstream of the respective rolling stand at the latest when the strip head is inlet into the rolling stand arranged directly downstream of the respective rolling stand. The control command is determined in this case in such a way that the head displacement, the outlet side head pitch and/or the outlet side head curvature are/is reduced such that the strip is centered—with reference to the rolling center line.

However, it is provided in a refinement that the respective head displacement, the respective outlet side head pitch and the respective outlet side head curvature are stored, that after the threading of the strip into the last rolling stand of the rolling train the strip located between the rolling stands is subjected to tension, that the strip—always as seen relative to the rolling center line—is inlet into each of the rolling stands with a known respective strip displacement and a known respective inlet side strip pitch, and is outlet from the respective rolling stand with the respective strip displacement, a respective outlet side strip pitch and a respective outlet side strip curvature, that the respective outlet side strip pitch is determined with the aid of the respective inlet side strip pitch and the respective pass reduction taking place in the respective rolling stand, that a respective intermediate stand strip displacement of the strip is acquired by means of the position acquisition device arranged directly downstream of the respective rolling stand, that the respective outlet side strip curvature is determined with the aid of the respective strip displacement, the respective outlet side strip pitch and the respective intermediate stand strip displacement, and that the respective strip displacement, the respective outlet side strip pitch and the respective intermediate stand strip displacement are also used to determine the respective control intervention.

It is possible for the respective control command to be determined within the scope of the last-mentioned refinement in particular in such a way that the respective control intervention counteracts a deflection of a strip foot of the strip as the strip foot is outlet from the respective rolling stand.

It is possible for the respective rolling stand and/or the rolling stand arranged directly downstream of the respective rolling stand to be driven at an instant corresponding to the determined respective control intervention at which the strip being inlet into the respective rolling stand is subjected to tension. In this case, it is of equal value in principle whether the respective rolling stand or the rolling stand arranged directly downstream of the respective rolling stand is driven in accordance with the determined respective control intervention.

Alternatively, it is possible that the respective rolling stand and/or the rolling stand arranged directly downstream of the respective rolling stand are/is driven at an instant corresponding to the determined respective control intervention at which the strip being inlet into the respective rolling stand is free from tension. It is possible in principle in this case as well to drive the respective rolling stand in accordance with the determined respective control intervention. However, the rolling stand arranged directly downstream of the respective rolling stand is preferably driven in this case.

The head displacement and the inlet side head pitch of the strip being inlet into the first rolling stand must be known. For example, it is possible to set the head displacement and/or the inlet side head pitch to defined values by means of suitable guide devices, for example to head displacement and inlet side head pitch=0. Alternatively, it is possible to arrange upstream of the first rolling stand a position acquisition device by means of which the corresponding values are acquired. It is also possible in principle to combine the two measures. For example, one of the two variables of head displacement and inlet side head pitch can be set to a defined value by an appropriate guide device, while the other value can be determined by acquiring the position of the strip.

The curvature of the strip between two rolling stands directly following one another is known from the procedure according to various embodiments. It is therefore possible to use the head displacement and the outlet side head pitch of the strip head of a specific rolling stand, as well as the respective outlet side head curvature in conjunction with the previously known distance from the rolling stand arranged directly downstream in order to determine the head displacement and the inlet side head pitch with which the strip is inlet into the rolling stand arranged directly downstream.

Thus, it is possible for the respective head displacement, the respective outlet side head pitch and the respective outlet side head curvature of the respective rolling stand to be used to determine the respective head displacement and the respective inlet side head pitch for the rolling stand arranged directly downstream of the respective rolling stand.

As an alternative to acquiring an intermediate stand head displacement and determining the outlet side head curvature with the aid (inter alia) of the acquired intermediate stand head displacement, it is possible that a mathematical-physical model is fed the respective head displacement and the respective outlet side head pitch, actual quantities of the strip being inlet into the respective rolling stand and of the strip being outlet from the respective rolling stand, as well as variables and parameters of the respective rolling stand, and the respective outlet side head curvature is determined by means of the mathematical-physical model.

This procedure has the advantage that it can be executed very quickly. In particular, the outlet side head curvature can be determined virtually at the same time as the strip head is being inlet into the respective rolling stand. It is therefore particularly possible with this procedure for the respective control intervention to be determined directly after the determination of the respective outlet side head curvature, and, directly after the determination of the respective control intervention, for the respective rolling stand to be driven in accordance with the determined respective control intervention.

It is even better to combine with one another the two fundamental refinements (that is to say using position acquisition devices, on the one hand, and using a model, on the other hand). It is provided in this case that after the determination of the respective outlet side head curvature by means of the mathematical-physical model a respective intermediate stand head displacement of the strip is additionally acquired by means of a respective position acquisition device arranged between the respective rolling stand and the rolling stand arranged directly downstream of the respective rolling stand, and that the respective outlet side head curvature is corrected with the aid of the respective acquired intermediate stand head displacement, the respective head displacement and the respective outlet side head pitch.

In a refinement of the last-named procedure, it is provided that the mathematical-physical model is adapted with the aid of a deviation of the respective outlet side head curvature determined by means of the mathematical-physical model from the corrected respective outlet side head curvature. The mathematical-physical model is thus trained such that the outlet side head curvature, determined with the aid of the mathematical-physical model, of strips rolled in the future need be corrected less and less, that is to say the model is adapted better and better to reality.

As already mentioned, the respective determined control intervention at a rolling stand of the rolling train can be output at various instants. In particular, it is possible for the rolling stand arranged directly downstream of the respective rolling stand to be driven in accordance with the determined respective control intervention at the latest as the strip is being threaded into the rolling stand arranged directly downstream of the respective rolling stand.

The respective outlet side head curvature can be constant. Alternatively, the respective outlet side head curvature can vary with the distance from the respective rolling stand, for example it can be a linear function of the distance or be constant in sections.

According to other embodiments, programming means can be provided by a computer program and a data medium having the features of the computer program as mentioned above.

According to various embodiments, the computer program has machine code which can be executed directly by a control device of a multistand rolling train, and the execution of which via the control device has the effect that the control device operates the rolling train in accordance with an operating method of the type according to various embodiments. The data medium is configured by various embodiments in such a way that such a computer program is stored on it.

According to further embodiments, a control device of a multistand rolling train may have the features of the control device. According to yet other embodiments, a rolling train can be provided.

According to various embodiments, the control device can be configured in such a way that it operates the rolling train in accordance with an operating method according to various embodiments. The rolling train has a plurality of rolling stands through which a strip runs successively, and a control device of the type thus described such that when in operation the rolling train is operated in accordance with an operating method according to various embodiments.

It is preferred for the control device to be designed as a software programmable control device that in operation executes a computer program of the type described above.

Figure 2:
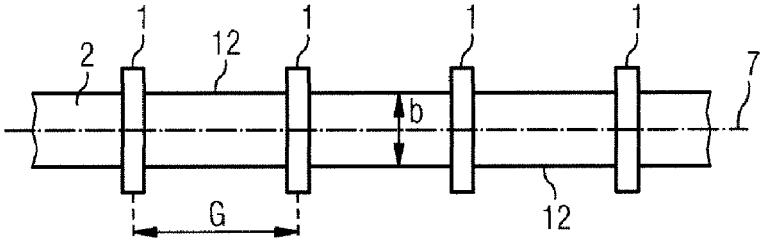
FIG. 2 shows the rolling train of FIG. 1 from above.

In accordance with FIGS. 1 and 2, a rolling train has a plurality of rolling stands 1. The rolling train is therefore designed as a multistand rolling train. In the operation of the rolling train, a strip 2 runs through the rolling stands 1 successively. The rolling train further has a control device 3 that controls the rolling stands 1 and other components of the rolling train during operation of the rolling train. The control device 3 is designed in such a way that in operation it operates the rolling train in accordance with an operating method that is explained in more detail below.

The control device 3 can be designed as a hard wired control device, as a programmably wired control device, or as a software programmable control device. As a rule, the control device 3 is designed as a software programmable control device that in operation executes a computer program 4. The computer program 4 in this case has machine code 5 which can be executed directly by the control device 3. Execution of the machine code 5 by the control device 3 has the effect that the control device 3 operates the rolling train in accordance with the operating method according to various embodiments.

The control device 3 can be programmed by the computer program 4 in any way desired. For example, the computer program 4 can already be stored in the control device 3 in the course of the production of the control device 3. Alternatively, it is, for example, possible to feed the computer program 4 to the control device 3 via a computer-computer connection. By way of example, the computer-computer connection can be an interface with a LAN or with the Internet. The computer-computer connection is not illustrated in FIGS. 1 and 2. Alternatively, it is possible in turn to store the computer program 4 on a data medium 6, and to feed the computer program 4 to the control device 3 via the data medium 6. The data medium 6 is illustrated as a CD-ROM in FIG. 1 purely by way of example. However, it could alternatively be designed in another way, for example as a USB memory stick or as a memory card.

The basic principle of the operating method according to various embodiments is explained in more detail below in conjunction with FIG. 3.

Figure 3:
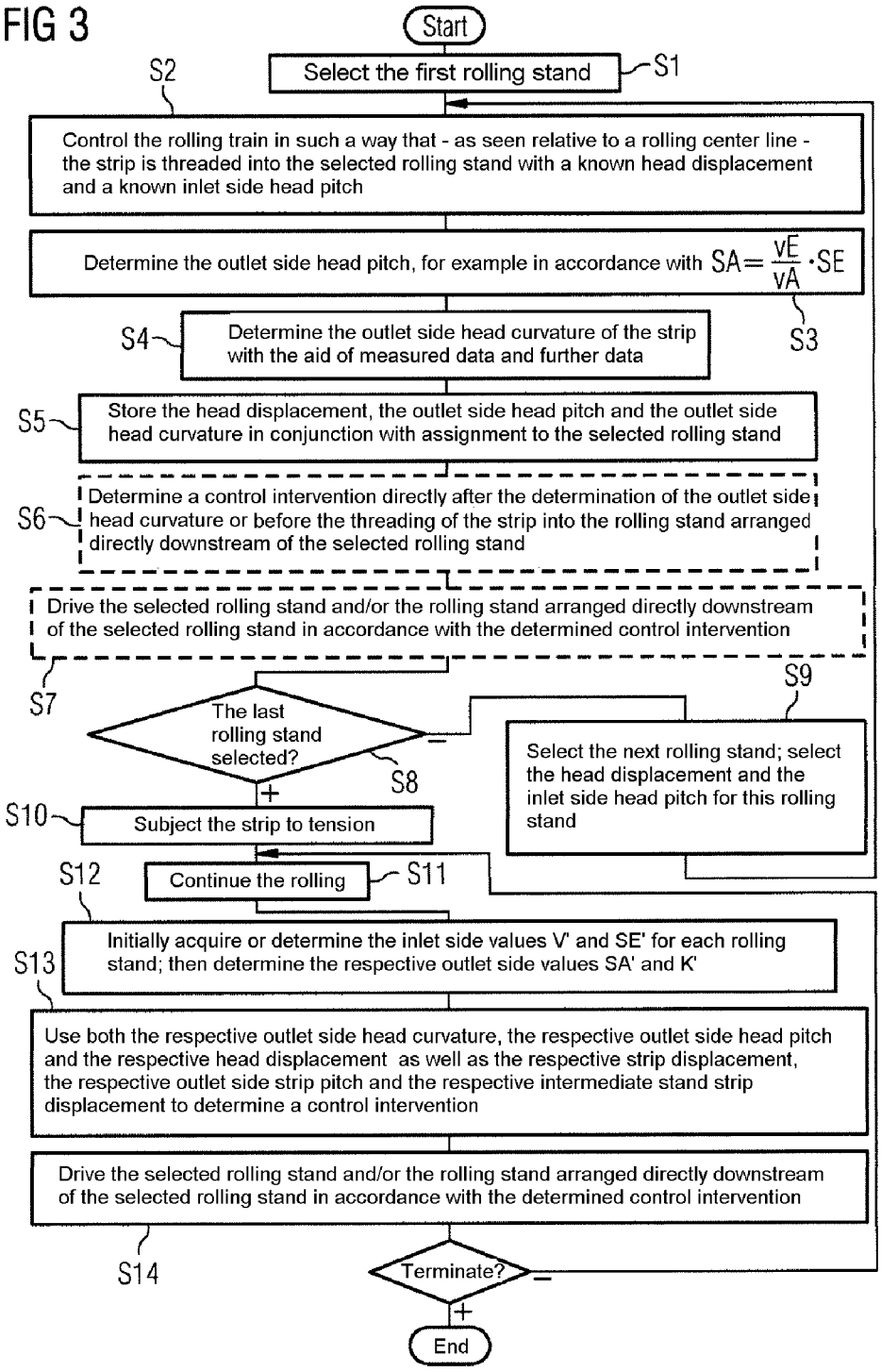
FIG. 3 shows a flowchart.
Figure 4:
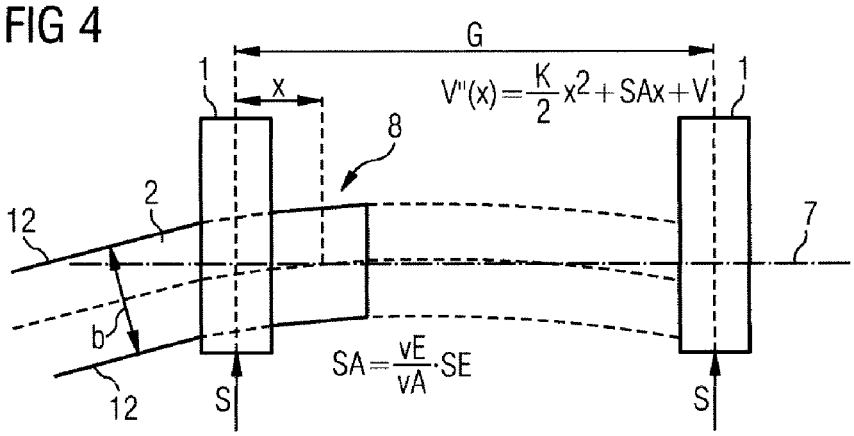
FIG. 4 is a schematic of a rolling stand and of the strip being inlet into the rolling stand and the strip running out of the rolling stand.

In accordance with FIG. 3, the control device 3 initially selects in a step S1 the rolling stand 1 into which the strip 2 is firstly threaded. The control device 3 then controls the rolling train in a step S2 in such a way that—as seen relative to a rolling center line 7 (compare FIGS. 2 and 4)—the strip 2 is threaded into the selected rolling stand 1 with a known head displacement V and a known inlet side head pitch SE. Owing to the threading into the selected rolling stand 1, a strip head 8 of the strip 2 runs out (in terms purely of effect) from the selected rolling stand 1 with the head displacement V, an outlet side head pitch SA and an outlet side head curvature K.

The circumstances on the basis of which the head displacement V and the inlet side head pitch SE are known for the first rolling stand 1 run through can be of a different nature. Thus, for example, it is possible for there to be present corresponding guide devices that are not illustrated in FIGS. 1 and 2 and on the basis of which the head displacement V and the inlet side head pitch SE must have predetermined values, for example head displacement V=0 and inlet side head pitch SE=0. Alternatively or in addition, it is possible to provide acquisition devices by means of which the head displacement V and/or the inlet side head pitch SE is/are acquired upstream of the first rolling stand 1 and transmitted to the control device 3.

In a step S3, the control device 3 uses the inlet side head pitch SE and a pass reduction occurring in the selected rolling stand 1 to determine the outlet side head pitch SA. In particular, the outlet side pass reduction SA can be determined in accordance with the relationship $$SA = \frac{vE}{vA} \cdot SE. \tag{1}$$

Here, vE and vA are the inlet side and the outlet side speed of the strip 2 relative to the selected rolling stand 1. The speeds vE and vA are linked to the pass reduction by the continuity equation.

Furthermore, the control device 3 determines the outlet side head curvature K of the strip 2 in a step S4. Here, the determination is performed with the aid of measured data and further data. Both the measured data and the further data refer here to the instantaneously selected rolling stand 1. Possible types of determination are explained in more detail below in connection with possible refinements according to various embodiments.

In a step S5, the head displacement V, the outlet side head pitch SA and the outlet side head curvature K of the strip head 8 are stored for the selected rolling stand 1—in conjunction with assignment to this rolling stand 1. The step S5 is important in the scope of a possible refinement according to various embodiments.

It is possible to determine a control intervention S directly after the determination of the outlet side head curvature K. This is illustrated in a step S6. It is likewise illustrated in step S6 that it is alternatively possible to determine the control intervention S not actually directly, but before the strip 2 is threaded into the rolling stand 1 arranged directly downstream of the selected rolling stand 1. However, in both cases the step S6 is only optional, and is therefore illustrated only by dashes in FIG. 3. If it is present, the control intervention S is determined by using the outlet side head curvature K, if appropriate by making additional use of the outlet side head pitch SA and/or the head displacement V. The control intervention S is determined hereby for the selected rolling stand 1 and/or for the rolling stand 1 arranged directly downstream of the selected rolling stand 1. If appropriate, it is also possible to determine two mutually different control interventions S, one each of the two control interventions S being determined for the selected rolling stand 1 and for the rolling stand 1 arranged directly downstream of the selected rolling stand 1.

When the step S6 is present, the rolling stand 1 for which the control intervention S determined in the step S6 is determined is driven in a step S7 in accordance with the determined control intervention S. However, since it is a consequence of the step S6, the step S7 is likewise only optional, and therefore illustrated only by dashes in FIG. 3.

When the determined control intervention S is determined for the selected rolling stand 1, it is preferred that the control intervention S be determined directly after the determination of the outlet side head curvature K, and that the selected rolling stand 1 be driven directly after the determination of the control intervention S in accordance with the determined control intervention S. When the control intervention S is output in the step S7 to the rolling stand 1 arranged directly downstream of the selected rolling stand 1, it is sufficient for the control intervention S to be determined at any desired instant at which the strip 2 has not yet been threaded into the rolling stand 1 arranged directly downstream of the selected rolling stand 1. This is because it is sufficient in this case that the rolling stand 1 arranged directly downstream of the selected rolling stand 1 be driven at the latest when the strip 2 is threaded in accordance with the determined control intervention S into the rolling stand 1 arranged directly downstream of the selected rolling stand 1.

In a step S8, the control device 3 checks whether the instantaneously selected rolling stand 1 is the last rolling stand 1 of the rolling train 1. If this is not the case, the control device 3 selects the next rolling stand 1 in a step S9 and determines the head displacement V and the inlet side head pitch SE for this rolling stand 1. This is because the relationship $$V''(x) = \frac{K}{2} \cdot x^2 + SA \cdot x + V \tag{2}$$

applies (for small outlet side head curvatures K, which is the case in practice) to the displacement V" of the strip head 8 from the rolling center line 7 as a function of the distance x from the respective rolling stand 1. Consequently, the values KA, SA and V of the preceding rolling stand 1, and the known stand distance G can be used straight away to determine the head displacement V for the newly selected rolling stand 1. The corresponding inlet side head pitch SE for the newly selected rolling stand 1 is yielded in a similar way with the aid of the relationship $$SE = K \times + SA \tag{3},$$

the reference symbol "SE" in equation 3 referring to the newly selected rolling stand 1, and the reference symbols "K" and "SA" referring to the rolling stand 1 arranged directly upstream. As before, the stand distance G must be used for x.

After the step S9 has been processed, the control device 3 goes back to the step S2.

If it was decided in the step S8 that the last rolling stand 1 has already been selected, the control device proceeds to a step S10. In the step S10, the strip 2 is subjected to tension, at least if it is located between the rolling stands 1. Rolling is then continued in a step S11.

During rolling, the strip 2 is inlet—always as seen relative to the rolling center line 7—into each of the rolling stands 1 with a respective strip displacement V' and a respective inlet side strip pitch SE'. Furthermore, the strip 2 runs out from each of the rolling stands 1 with the respective strip displacement V', a respective outlet side strip pitch SA' and a respective outlet side strip curvature K'. The strip displacements V', the strip pitches SE', SA' and the outlet side strip curvatures K' need not here be the same values as the values previously determined for the strip head 8. Nevertheless, the situation is that the values are known. It is also possible for them to change with time. Nevertheless, the values can be determined.

This is because the inlet side values V', SE' for the first rolling stand 1 are known. It is therefore possible in conjunction with the pass reduction to determine the outlet side values SA', K' for the first rolling stand 1. However, given knowledge of the outlet side values SA', K' of a respective rolling stand 1 it is possible—in a way similar to the above equations 2 and 3—to determine the inlet side values V', SE' for the rolling stand 1 respectively arranged directly downstream. In particular, it is therefore possible firstly to acquire or to determine the inlet side values (strip displacement V' and inlet side strip pitch SE') in a step S12 for each of the rolling stands 1, and then to determine the respective outlet side strip pitch SA' with the aid of the respective inlet side strip pitch SE' and the respective pass reduction occurring in the respective rolling stand 1. It is possible, furthermore, to determine the respective outlet side strip curvature K' in a way similar to the respective outlet side head curvature K.

Figure 6:
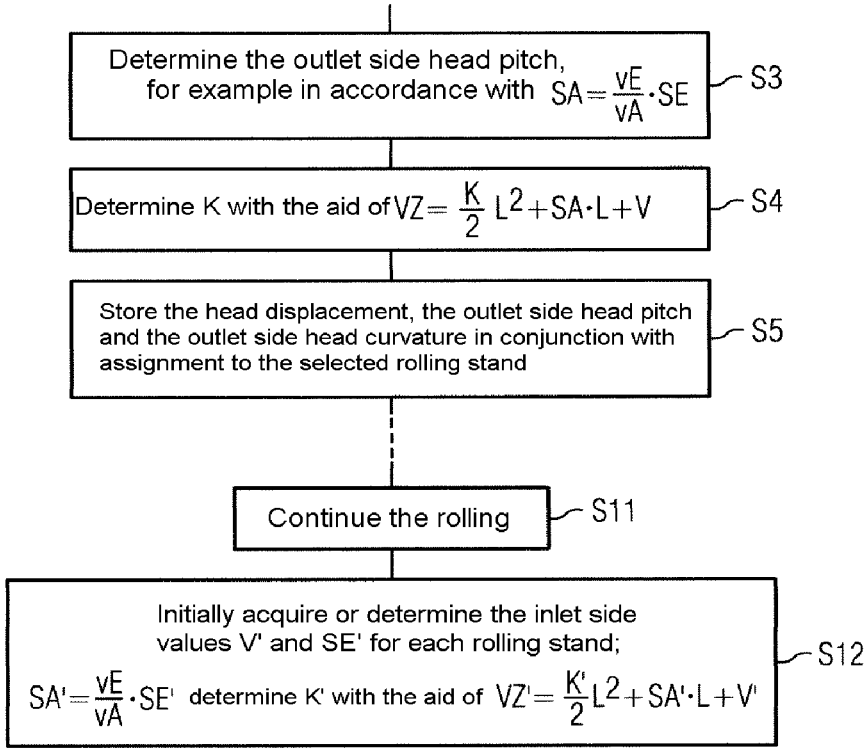
FIG. 6 shows a flowchart.

In order to carry out the step S12 reliably, it is sensible to determine the respective outlet side curvatures K, K' in the most reliable way. It is therefore preferred to proceed in accordance with FIG. 5 such that a position acquisition device 10 is respectively arranged between two rolling stands 1 in each case—preferably in the region of a loop lifter 9. With the aid of the position acquisition devices 10 it is possible—in each case with reference to the rolling stand 1 arranged directly upstream—to acquire a respective intermediate stand head displacement VZ of the strip head 8. In this case, the respective intermediate stand head displacement VZ, the respective head displacement V and the respective outlet side head pitch SA of the strip head 8 can be used with the aid of the relationship $$VZ = \frac{K}{2}L^2 + SA \cdot L + V \tag{4}$$

to determine the respective outlet side head curvature K for the rolling stand 1 arranged directly upstream of the respective position acquisition device 10. Here, L is the distance of the respective position acquisition device 10 from the rolling stand 1 arranged directly upstream. In a similar way, it is also possible during the rolling of the strip 2, that is to say while the strip 2 is subjected to tension, to determine an intermediate stand strip displacement VZ' and, with the aid of the intermediate stand strip displacement VZ' in conjunction with the outlet side strip pitch SA' and the strip displacement V' of the strip 2 for the rolling stand 1 arranged directly upstream, the corresponding outlet side strip curvature K'. This procedure is illustrated schematically in FIG. 6, in which the steps S4 and S12 of FIG. 3 are correspondingly illustrated.

As an alternative or in addition to the determination in accordance with the step S6, in a step S13 a respective control intervention S is determined with reference to each of the rolling stands 1. In a step S14, the respective rolling stand 1 and/or the rolling stand 1 arranged directly downstream of the respective rolling stand 1 are/is then driven in a fashion corresponding hereto.

The determination of the respective control intervention S is performed in the course of the step S13 also by using the respective strip displacement V', the respective outlet side strip pitch SA' and the respective intermediate stand strip displacement VZ'. The respective control intervention S is determined in the course of the step S13, that is to say both by using the respective outlet side head curvature K, the respective outlet side head pitch SA and the respective head displacement V, as well as by using the respective strip displacement V', the respective outlet side strip pitch SA' and the respective intermediate stand strip displacement VZ'. As well as using the respective intermediate stand strip displacement VZ', equal weighting is given in this case to using the respective outlet side strip curvature K', because these two variables can be converted into one another straight away.

In particular, it is possible to determine an original strip line with the aid of the respective head variables V, SA, K, to determine an instantaneous strip line with the aid of the respective strip variables V', SA', K', and to interpret the difference between these two lines as a stress state in the strip 2. In the course of the step S13, this knowledge can be used for the purpose of determining the respective control intervention S in such a way that the respective control intervention S counteracts deflection of a strip foot 11 of the strip 2 as the strip foot 11 runs out from the respective rolling stand 1.

Figure 7:
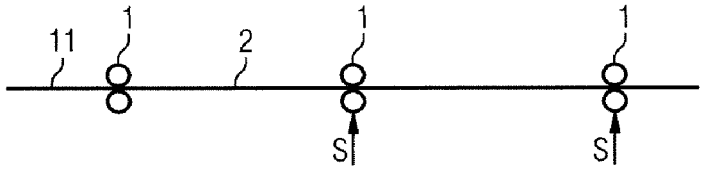
FIGS. 7 and 8 are respectively schematics of a part of the rolling train of FIG. 1.

For example, as illustrated in FIG. 7, it is possible for the respective rolling stand 1 and/or the rolling stand 1 arranged directly downstream of the respective rolling stand 1 to be driven at an instant corresponding to the determined respective control intervention S at which the strip 2 being inlet into the respective rolling stand 1 is (still) subjected to tension. Alternatively, as illustrated in FIG. 8, it is possible for the respective rolling stand 1 and/or the rolling stand 1 arranged directly downstream of the respective rolling stand 1 to be driven at an instant corresponding to the determined respective control intervention S at which the strip being inlet into the respective rolling stand 1 is (already) free from tension.

Figure 8:
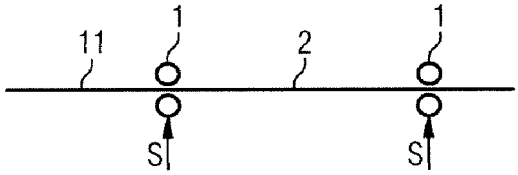

In these two cases, that is to say both in the refinement in accordance with FIG. 7 and in the refinement in accordance with FIG. 8, the respective control intervention S must, of course, have been determined in advance by the control device 3. The respective control intervention S is preferably determined in this case directly beforehand. However, it is possible as an alternative to determine the respective control intervention S at a definite distance in time ahead of the driving of the respective rolling stand 1 and/or of the rolling stand 1 arranged directly downstream of the respective rolling stand 1.

A procedure was explained above in which the outlet side head curvature K or the outlet side strip curvature K' was determined once, and assumed to be constant within a rolling train section (that is to say between two respectively directly adjacent rolling stands 1). However, other procedures are also possible.

For example, it is possible to provide two or more position acquisition devices 10 per rolling train section. The arrangement of the position acquisition devices 10 is optimum in this case when the position acquisition devices 10 are uniformly spaced apart from one another. For example, a position acquisition device 10 can be respectively arranged in the middle between two respectively directly adjacent rolling stands 1, and a further position acquisition device 10 can be arranged directly upstream of the rolling stand 1 arranged directly downstream of the respective rolling stand 1. However, in practice it may necessary for overriding reasons to deviate from this arrangement—which is optimum in terms of measuring accuracy.

When two or more position acquisition devices 10 are provided per rolling train section, it is possible for the course of the curve of the strip 2 between two respectively directly adjacent rolling stands 1 to be approximated not only by a polynomial of second degree (that is to say with constant curvature K or K'), but by means of a polynomial of, for example, third degree (that is to say with linearly varying curvature K or K' as seen in the strip running direction).

Independently of whether the curvatures K and K' between two respectively directly adjacent rolling stands 1 are constant or a function of the location x in the strip running direction, it is possible, in particular, to apply the Bernoulli-Euler theory of the transverse beam, which is known per se, to reach a conclusion of a tension difference Δσ from strip edge 12 to strip edge 12 with the aid of the local curvatures K and K'. This is because it holds for the tension difference Δσ that $$\Delta\sigma = \frac{6M(x)}{b^2h}. \tag{5}$$

Here, b is the strip width, h the strip thickness and M corresponds to the local flexural torque. The local flexural torque M is, for its part, linked to the curvatures K and K' by the relationship $$K'(x) - K(x) = \frac{M(x)}{EI}. \tag{6}$$

Here, E is the modulus of elasticity of the strip 2, if appropriate for the instantaneous strip temperature, and I is the axial surface moment of the strip cross section in the strip thickness direction. The axial surface moment I is determined here by the relationship $$I = \frac{hb^3}{12}. \tag{7}$$

Figure 5:
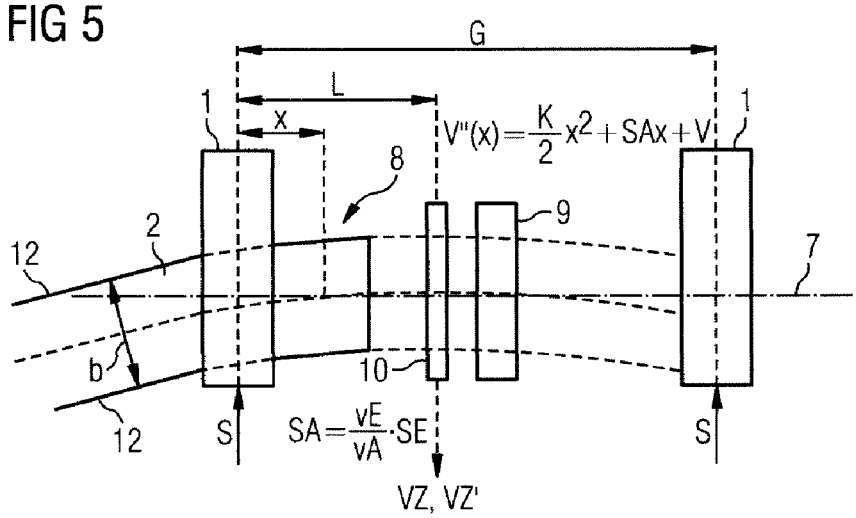
FIG. 5 is a schematic of a section of the rolling train that is delimited by two rolling stands.
Figure 9:
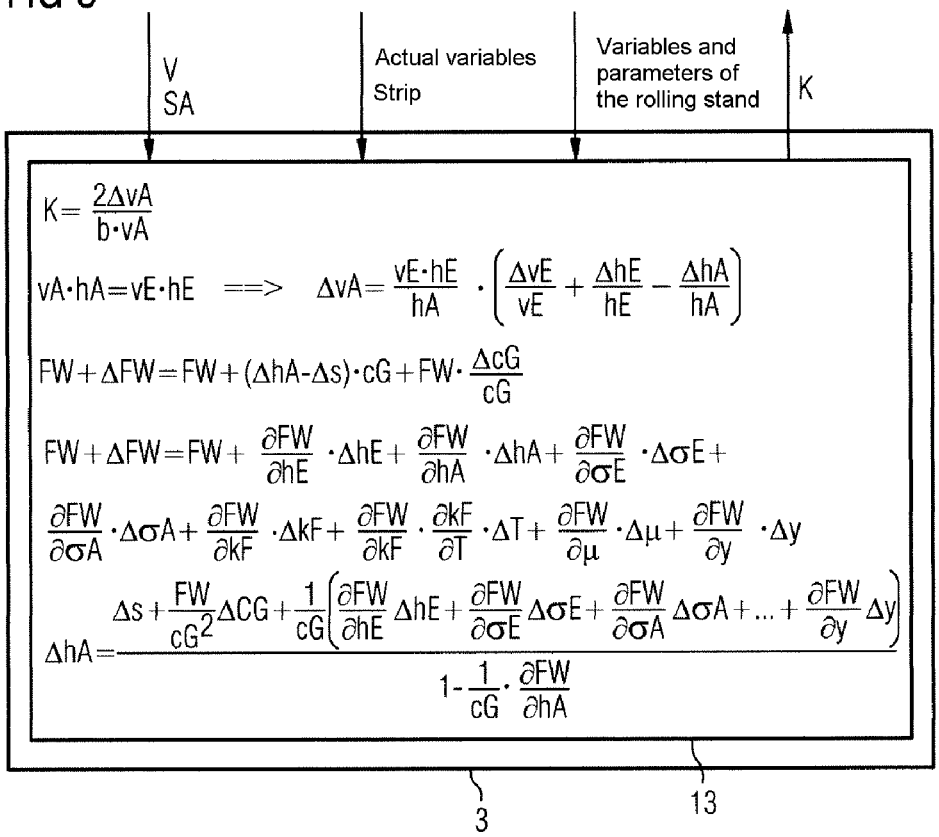
FIG. 9 is a schematic of a possible refinement of the rolling train from FIG. 1.

FIG. 9 shows a possibility for determining the outlet side curvatures K, K' without the need for a position acquisition device 10 in accordance with FIG. 5. In accordance with FIG. 9, a mathematical-physical model 13 is implemented in the control device 3. In accordance with FIG. 10, in a step S21 the respective head displacement V and the respective outlet side head pitch SA are fed for each rolling stand 1 to the mathematical-physical model 13. Furthermore, in the step S21 actual variables of the strip 2 being inlet into the respective rolling stand 1, and of the strip 2 running out from the respective rolling stand 1 are fed to the mathematical-physical model 13. Finally, variables and parameters of the respective rolling stand 1 are fed in the step S21 to the mathematical-physical model 13. In a step S22, the respective outlet side head curvature K, K' is then determined by means of the mathematical-physical model 13.

The mathematical-physical model 13 is based, firstly, on the idea that the outlet side head curvature K of the strip 2 downstream of each of the rolling stands 1 follows the relationship $$K = \frac{2\Delta vA}{b \cdot vA}. \tag{8}$$

Here, ΔvA is the speed difference with which the strip edges 12 run out from the respective rolling stand 1.

A similar statement also holds, furthermore, for other Δ variables. Thus, for example, vE is the speed at which the middle of the strip 2 is inlet into the respectively considered rolling stand 1, and ΔvE is the speed difference at which the strip edges 12 are inlet into the respectively considered rolling stand 1.

Furthermore, the continuity equation $$vA \cdot hA = vE \cdot hE \tag{9}$$

holds—both locally as seen across the strip width b, and globally. Here, hA and hE which refer to the respective rolling stand 1 are the outlet side and the inlet side strip thickness, respectively.

When solved for the outlet side speed vA, equation 9 yields the linearized equation for the lateral speed differences about the center of the strip across the strip width b as $$\Delta vA = \frac{vE \cdot hE}{hA} \cdot \left(\frac{\Delta vE}{vE} + \frac{\Delta hE}{hE} - \frac{\Delta hA}{hA}\right). \tag{10}$$

The inlet side variables (that is to say the variables with the final letter "E") are known in this case without exception, specifically a priori for the rolling stand 1 run through first, and via appropriate calculation with the aid of the mathematical-physical model 13 for the other rolling stands 1. Again, the (average) outlet side band thickness hA is known—on the basis of the known pass reduction. The outlet side band thickness difference ΔhA is yielded by equating the two relationships $$FW + \Delta FW = FW + (\Delta hA - \Delta s) \cdot cG + FW \cdot \frac{\Delta cG}{cG} \tag{11}$$

and $$FW + \Delta FW = FW + \frac{\partial FW}{\partial hE} \cdot \Delta hE + \frac{\partial FW}{\partial hA} \cdot \Delta hA + \frac{\partial FW}{\partial \sigma E} \cdot \Delta\sigma E + \frac{\partial FW}{\partial \sigma A} \cdot \Delta\sigma A + \frac{\partial FW}{\partial kF} \cdot \Delta kF + \frac{\partial FW}{\partial kF} \cdot \frac{\partial kF}{\partial T} \cdot \Delta T + \frac{\partial FW}{\partial \mu} \cdot \Delta\mu + \frac{\partial FW}{\partial y} \cdot \Delta y \tag{12}$$

to $$\Delta hA = \frac{\Delta s + \frac{FW}{cG^2}\Delta CG + \frac{1}{cG}\left(\frac{\partial FW}{\partial hE}\Delta hE + \frac{\partial FW}{\partial \sigma E} + \frac{\partial FW}{\partial \sigma A} + \ldots + \frac{\partial FW}{\partial y}\Delta y\right)}{1 - \frac{1}{cG} \cdot \frac{\partial FW}{\partial hA}}. \tag{13}$$

Here, in equations 11 to 13 FW signifies the rolling force, s the roll gap, cG the stand stiffness, kF the deformation strength, T the temperature of the strip 2, μ the friction coefficient in the roll gap, and y the eccentricity (corresponding to the head displacement V) with which the strip 2 runs through the respectively considered rolling stand 1.

The corresponding input variables of the mathematical-physical model 13 need to be known in this case to the control device 3. However, this is usually the case in practice, and so the outlet side height difference ΔhA can be determined.

The procedure described above in conjunction with FIG. 9 operates very quickly. In particular, the outlet side head curvature K is available practically at once. Consequently, it is possible in principle to react equally quickly. In particular, as already mentioned in principle and illustrated in FIG. 10 once again, it is possible to determine the respective control intervention S directly after the determination of the respective outlet side head curvature K, and to drive the respective rolling stand 1 directly after the determination of the respective control intervention S in accordance with the determined respective control intervention S. In this case, there is frequently a reaction of the respective rolling stand 1 before the strip head 8 is inlet into the rolling stand 1 arranged directly downstream.

However, it would be possible in principle to set back the driving of the respective rolling stand 1 until the strip head 8 has been inlet into the rolling stand 1 arranged directly downstream.

Figure 10:
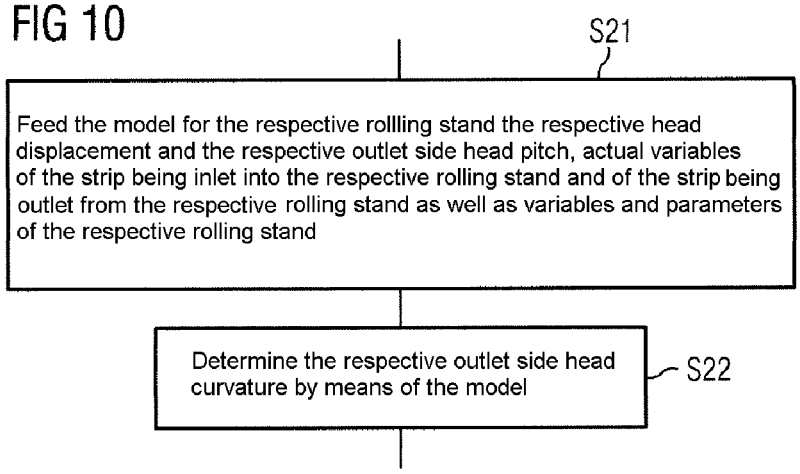
FIG. 10 shows a flowchart.

In the case of the procedure in accordance with FIG. 10, the strip 2 has a head curvature K which is constant in sections. The length of the individual sections within which the strip 2 has a constant head curvature K is, however, substantially smaller as a rule than the distance G of the rolling stands 1 from one another. The determination of the head displacement V" as a function of the position of the strip 2 in the rolling train is therefore no longer as easily possible as previously described. However, it is still possible, since the individual sections border on one another continuously.

Figure 11:
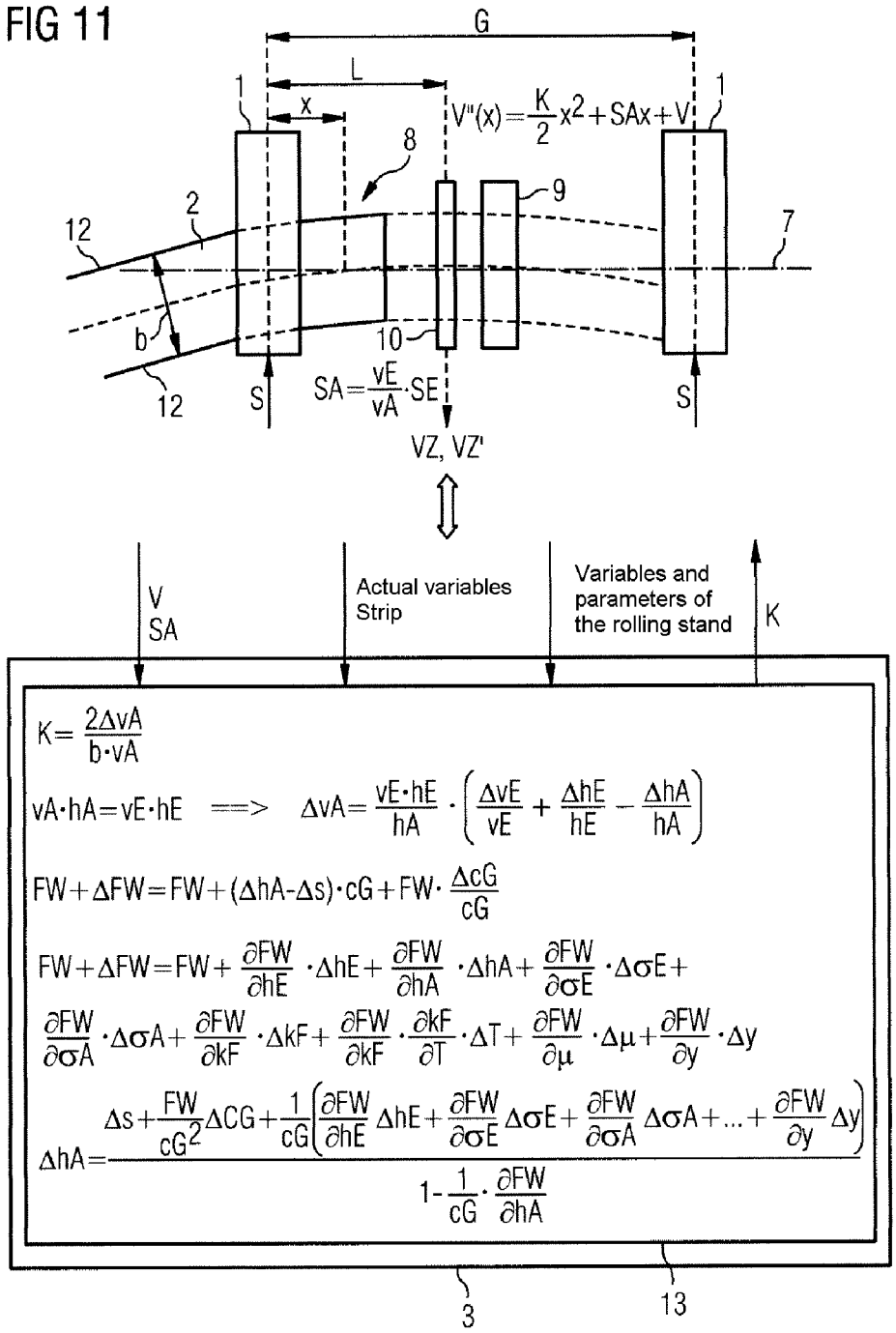
FIG. 11 shows a modification of FIG. 9.
Figure 12:
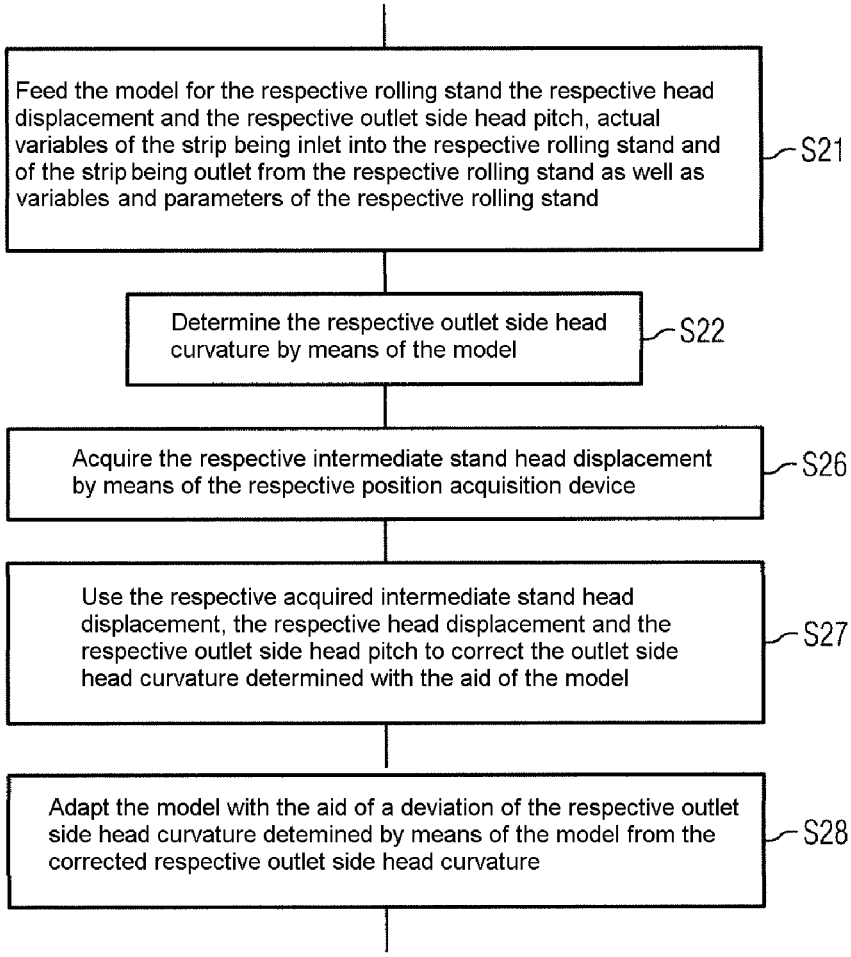
FIG. 12 shows a flowchart.

It is possible to design the procedure of FIGS. 9 and 10 in an isolated fashion, that is to say without providing position acquisition devices 10 between the rolling stands 1. However, it is preferred to carry out the procedure of FIGS. 9 and 10 in accordance with FIG. 11 in conjunction with the position acquisition devices 10. In this case, in addition to the steps S21 and S22 of FIG. 10, in accordance with FIG. 12 it is possible first to acquire the respective intermediate stand head displacement VZ in a step S26 by means of the respective position acquisition device 10, and then to correct in a step S27 the outlet side head curvature K, determined with the aid of the mathematical-physical model 13, with the aid of the respective acquired intermediate stand head displacement VA, the respective head displacement V and the respective outlet side head pitch SA.

As a rule, the respective outlet side head curvature K is calculated anew here in the course of the step S27 in accordance with the last-named variables (head displacement V, outlet side head pitch SA and intermediate stand head displacement VZ). The newly calculated outlet side head curvature K then replaces the outlet side head curvature K determined previously with the aid of the mathematical-physical model 13. Alternatively, an at least substantial approximation, for example by 70, 75 or 80%, is possible.

In addition to the step S27, a step S28 can furthermore be present. In the step S28, the mathematical-physical model 13 is adapted with the aid of a deviation of the respective outlet side head curvature K determined by means of the mathematical-physical model 13 from the corrected respective outlet side head curvature K. The mathematical-physical model 13 as such is thus adapted to the actual circumstances such that the outlet side head curvature K is determined more effectively by the mathematical-physical model 13 for strips 2 rolled at a later instant.

As already mentioned, when use is made of the mathematical-physical model 13 it is possible to determine the respective control intervention S very quickly, and to drive the respective rolling stand 1 very quickly in accordance with the respective control intervention S. In the course of the procedure in accordance with FIGS. 11 and 12, it is therefore required to determine an effective (average) head curvature KM of the strip 2 while taking account of the control interventions S respectively determined with the aid of the mathematical-physical model 13 and of the changes thereby effected in the respective outlet side head curvature K, and to use the effective average head curvature KM as a basis for comparing the step S27 or the adaptation of the step S28. For example, it is possible to determine a respective outlet side head curvature K cyclically in each case with the aid of the mathematical-physical model 13, and then to determine the effective average head curvature KM—for example by means of the relationship $$KM=(1-\alpha)K(i-1)+\alpha K(i) \tag{14}$$

In the above equation 14, here i stands for the respective scanning cycle. $\alpha$ is a suitably determined weighting factor that lies between zero and one. The weighting factor $\alpha$ can be constant with time or variable with time. When it is variable with time, it preferably decreases in the course of time.

The present invention has many advantages. In particular, it operates reliably and can be implemented in a simple way and even be retrofitted in existing rolling trains.

The above description serves exclusively to explain the present invention. By contrast, the scope of protection of the present invention is intended to be determined solely by the attached claims.

What is claimed is:

1. An operating method for a rolling train that has a plurality of rolling stands through which a strip runs successively, comprising the steps of:

threading the strip into each of the rolling stands with a known respective head displacement in a lateral direction parallel to a rotational axis of a roller of a particular rolling stand and a known respective inlet side head pitch, such that a strip head of the strip is outlet from the respective rolling stand with the respective head displacement, a respective outlet side head pitch and a respective outlet side head curvature of the strip in the lateral direction, and for at least one of the rolling stands:

calculating the respective outlet side head pitch based on the respective inlet side head pitch and a respective pass reduction taking place in the respective rolling stand, while rolling the strip through the rolling train, measuring an intermediate stand head displacement of the strip head using a respective position acquisition device arranged between the respective rolling stand and the rolling stand arranged directly downstream of the respective rolling stand, calculating the respective outlet side head curvature of the strip in the lateral direction based on measured intermediate stand head displacement and respective further data, using the calculated respective outlet side head curvature to calculate a respective control intervention for at least one of the respective rolling stand and for a rolling stand arranged directly downstream of the respective rolling stand, and driving at least one of the respective rolling stand and the rolling stand arranged directly downstream of the respective rolling stand in accordance with the calculated respective control intervention.

2. The operating method according to claim 1, wherein the respective further data correspond to the respective head displacement and the respective outlet side head pitch.

3. The operating method according to claim 1, wherein the respective head displacement, the respective outlet side head pitch and the respective outlet side head curvature are stored, after the threading of the strip into the last rolling stand of the rolling train the strip located between the rolling stands is subjected to tension, the strip is inlet into each of the rolling stands with a known respective strip displacement and a known respective inlet side strip pitch, and is outlet from the respective rolling stand with the respective strip displacement, a respective outlet side strip pitch and a respective outlet side strip curvature, the respective outlet side strip pitch is determined with the aid of the respective inlet side strip pitch and the respective pass reduction taking place in the respective rolling stand, a respective intermediate stand strip displacement of the strip is acquired by means of the position acquisition device arranged directly downstream of the respective rolling stand, the respective outlet side strip curvature is determined with the aid of the respective strip displacement, the respective outlet side strip pitch and the respective intermediate stand strip displacement, and wherein the respective strip displacement, the respective outlet side strip pitch and the respective intermediate stand strip displacement are also used to determine the respective control intervention.

4. The operating method according to claim 3, wherein the respective control intervention is determined in such a way that the respective control intervention counteracts a deflection of a strip foot of the strip as the strip foot is outlet from the respective rolling stand.

5. The operating method according to claim 3, wherein at least one of the respective rolling stand and the rolling stand arranged directly downstream of the respective rolling stand are/is driven at an instant corresponding to the determined respective control intervention at which the strip being inlet into the respective rolling stand is subjected to tension.

6. The operating method according to claim 1, wherein at least one of the respective rolling stand and the rolling stand arranged directly downstream of the respective rolling stand are/is driven at an instant corresponding to the determined respective control intervention at which the strip being inlet into the respective rolling stand is free from tension.

7. The operating method according to claim 1, wherein the respective head displacement, the respective outlet side head pitch and the respective outlet side head curvature of the respective rolling stand are used to determine the respective head displacement and the respective inlet side head pitch for the rolling stand arranged directly downstream of the respective rolling stand.

8. The operating method according to claim 1, wherein a mathematical-physical model is fed the respective head displacement and the respective outlet side head pitch, actual quantities of the strip being inlet into the respective rolling stand and of the strip being outlet from the respective rolling stand, as well as variables and parameters of the respective rolling stand, and in that the respective outlet side head curvature is determined by means of the mathematical-physical model.

9. The operating method according to claim 8, wherein after the determination of the respective outlet side head curvature by means of the mathematical-physical model the respective intermediate stand head displacement of the strip is additionally acquired by means of the respective position acquisition device arranged between the respective rolling stand and the rolling stand arranged directly downstream of the respective rolling stand, and the respective outlet side head curvature is corrected with the aid of the respective acquired intermediate stand head displacement, the respective head displacement and the respective outlet side head pitch.

10. The operating method according to claim 9, wherein the mathematical-physical model is adapted with the aid of a deviation of the respective outlet side head curvature determined by means of the mathematical-physical model from the corrected respective outlet side head curvature.

11. The operating method according to claim 8, wherein the respective control intervention is determined directly after the determination of the respective outlet side head curvature, and in that directly after the determination of the respective control intervention the respective rolling stand is driven in accordance with the determined respective control intervention.

12. The operating method according to claim 1, wherein the rolling stand arranged directly downstream of the respective rolling stand is driven in accordance with the determined respective control intervention at the latest as the strip is being threaded into the rolling stand arranged directly downstream of the respective rolling stand.

13. The operating method according to claim 1, wherein the respective outlet side head curvature is constant.

14. The operating method according to claim 1, wherein the respective outlet side head curvature varies with a distance from the respective rolling stand.

15. A control device of a multistand rolling train in which a strip is threaded into each of the rolling stands with a known respective head displacement in a lateral direction parallel to a rotational axis of a roller of a particular rolling stand and a known respective inlet side head pitch, such that a strip head of the strip is outlet from the respective rolling stand with the respective head displacement, a respective outlet side head pitch and a respective outlet side head curvature of the strip in the lateral direction, the control device comprising instructions stored in non-transitory computer-readable media and executable by a processor to:

for each of at least one of the rolling stands:

calculate the respective outlet side head pitch based on the respective inlet side head pitch and a respective pass reduction taking place in the respective rolling stand, while rolling the strip through the rolling train, measure an intermediate stand head displacement of the strip head using a respective position acquisition device arranged between the respective rolling stand and the rolling stand arranged directly downstream of the respective rolling stand, calculate the respective outlet side head curvature of the strip in the lateral direction based on measured intermediate stand head displacement and respective further data, use the calculated respective outlet side head curvature to calculate a respective control intervention for at least one of the respective rolling stand and for a rolling stand arranged directly downstream of the respective rolling stand, and drive at least one of the respective rolling stand and the rolling stand arranged directly downstream of the respective rolling stand in accordance with the calculated respective control intervention.

16. A rolling train comprising:

a plurality of rolling stands through which a strip runs successively, wherein the strip is threaded into each of the rolling stands with a known respective head displacement in a lateral direction parallel to a rotational axis of a roller of a particular rolling stand and a known respective inlet side head pitch, such that a strip head of the strip is outlet from the respective rolling stand with the respective head displacement, a respective outlet side head pitch and a respective outlet side head curvature of the strip in the lateral direction, and a control device coupled to the plurality of rolling stands and configured to, for each of at least one of the rolling stands:

calculate the respective outlet side head pitch based on the respective inlet side head pitch and a respective pass reduction taking place in the respective rolling stand, while rolling the strip through the rolling train, measure an intermediate stand head displacement of the strip head using a respective position acquisition device arranged between the respective rolling stand and the rolling stand arranged directly downstream of the respective rolling stand, calculate the respective outlet side head curvature of the strip in the lateral direction based on measured intermediate stand head displacement and respective further data, use the calculated respective outlet side head curvature to calculate a respective control intervention for at least one of the respective rolling stand and for a rolling stand arranged directly downstream of the respective rolling stand, and drive at least one of the respective rolling stand and the rolling stand arranged directly downstream of the respective rolling stand in accordance with the calculated respective control intervention.

* * * * *